US011427008B2

(12) United States Patent
Kikuchi et al.

(10) Patent No.: US 11,427,008 B2
(45) Date of Patent: Aug. 30, 2022

(54) LIQUID DISCHARGE APPARATUS

(71) Applicants: Atsushi Kikuchi, Kanagawa (JP); Kazuhisa Yoda, Kanagawa (JP)

(72) Inventors: Atsushi Kikuchi, Kanagawa (JP); Kazuhisa Yoda, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 40 days.

(21) Appl. No.: 17/092,868

(22) Filed: Nov. 9, 2020

(65) Prior Publication Data

US 2021/0155003 A1 May 27, 2021

(30) Foreign Application Priority Data

Nov. 25, 2019 (JP) ..... JP2019-212246
May 12, 2020 (JP) ..... JP2020-083925

(51) Int. Cl.
*B41J 2/175* (2006.01)
*B41J 2/165* (2006.01)

(52) U.S. Cl.
CPC ..... *B41J 2/1752* (2013.01); *B41J 2/165* (2013.01); *B41J 2/16505* (2013.01); *B41J 2/16508* (2013.01); *B41J 2/16511* (2013.01); *B41J 2/16523* (2013.01); *B41J 2/1753* (2013.01); *B41J 2/17553* (2013.01); *B41J 2/17559* (2013.01)

(58) Field of Classification Search
CPC ..... B41J 2/1752; B41J 2/165; B41J 2/16505; B41J 2/16508; B41J 2/16511; B41J 2/16523; B41J 2/1753; B41J 2/17553; B41J 2/17559
USPC ..... 347/29, 31, 36
See application file for complete search history.

(56) References Cited

U.S. PATENT DOCUMENTS

2017/0106656 A1* 4/2017 Conzelmann ..... B41J 2/16547
2019/0283431 A1 9/2019 Kikuchi
2020/0247126 A1 8/2020 Kikuchi

FOREIGN PATENT DOCUMENTS

JP 2017-205956 11/2017

* cited by examiner

*Primary Examiner* — Kristal Feggins
*Assistant Examiner* — Alexander D Shenderov
(74) *Attorney, Agent, or Firm* — Duft & Bornsen, PC

(57) ABSTRACT

A liquid discharge apparatus includes a head configured to discharge a liquid, and a discharge receptacle configured to receive the liquid discharged from the head at an installation position. The discharge receptacle includes a liquid holder configured to receive the liquid discharged from the head, and a support configured to detachably support the liquid holder. At least a part of the support is displaceable to a detachment position at which the liquid holder is detachable from the support, and the detachment position is lower than the installation position.

18 Claims, 12 Drawing Sheets

LIQUID DISCHARGE APPARATUS

CROSS-REFERENCE TO RELATED APPLICATIONS

This patent application is based on and claims priority pursuant to 35 U.S.C. § 119 (a) to Japanese Patent Application No. 2019-212246, filed on Nov. 25, 2019, in the Japan Patent Office and Japanese Patent Application No. 2020-083925, filed on May 12, 2020, in the Japan Patent Office, the entire disclosures of which are hereby incorporated by reference herein.

BACKGROUND

Technical Field

Aspect of this disclosure relates to a liquid discharge apparatus.

Related Art

A liquid discharge apparatus includes a liquid discharge head. The liquid discharge apparatus performs a dummy discharge toward a dummy discharge receptacle that includes an absorbing member to maintain and recover a liquid discharge status (ability) of the liquid discharge head. The liquid discharge head discharges a liquid that does not contribute to printing in the dummy discharge. The dummy discharge is also referred to as a "flushing", a "purging", for example.

The liquid discharge apparatus includes a conveyor to hold a sheet on a cylindrical drum and conveys the sheet, the liquid discharge head to discharge the liquid toward the cylindrical drum, and a dummy discharge collector to collect the liquid discharged onto an area of the cylindrical drum at which the sheet is not held.

SUMMARY

In an aspect of this disclosure, a liquid discharge apparatus includes a head configured to discharge a liquid, and a discharge receptacle configured to receive the liquid discharged from the head at an installation position. The discharge receptacle includes a liquid holder configured to receive the liquid discharged from the head, and a support configured to detachably support the liquid holder. At least a part of the support is displaceable to a detachment position at which the liquid holder is detachable from the support, and the detachment position is lower than the installation position.

BRIEF DESCRIPTION OF THE SEVERAL VIEWS OF THE DRAWINGS

The aforementioned and other aspects, features, and advantages of the present disclosure will be better understood by reference to the following detailed description when considered in connection with the accompanying drawings, wherein.

Figure 1:
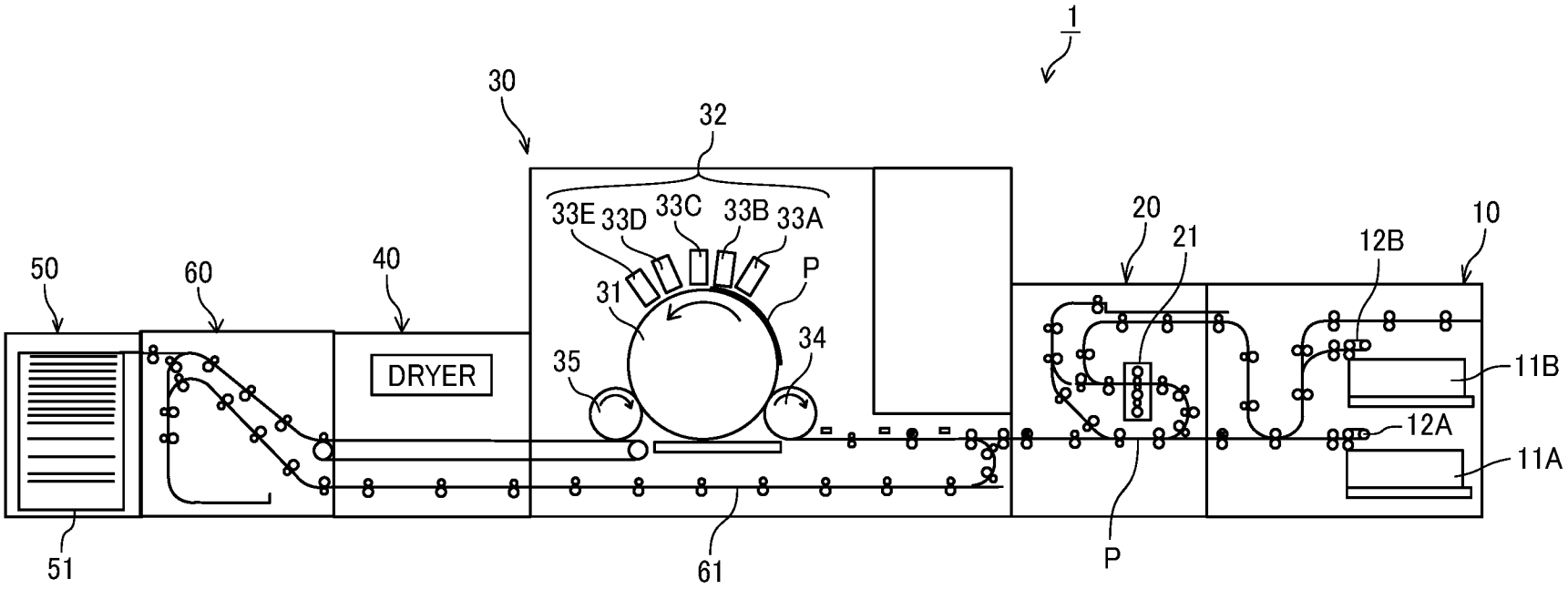
FIG. 1 is a schematic cross-sectional front view of a printer as a liquid discharge apparatus according to a first embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in a similar manner, and achieve similar results.

Although the embodiments are described with technical limitations with reference to the attached drawings, such description is not intended to limit the scope of the disclosure and all of the components or elements described in the embodiments of this disclosure are not necessarily indispensable. As used herein, the singular forms "a," "an," and "the" are intended to include the plural forms as well, unless the context clearly indicates otherwise.

Figure 2:
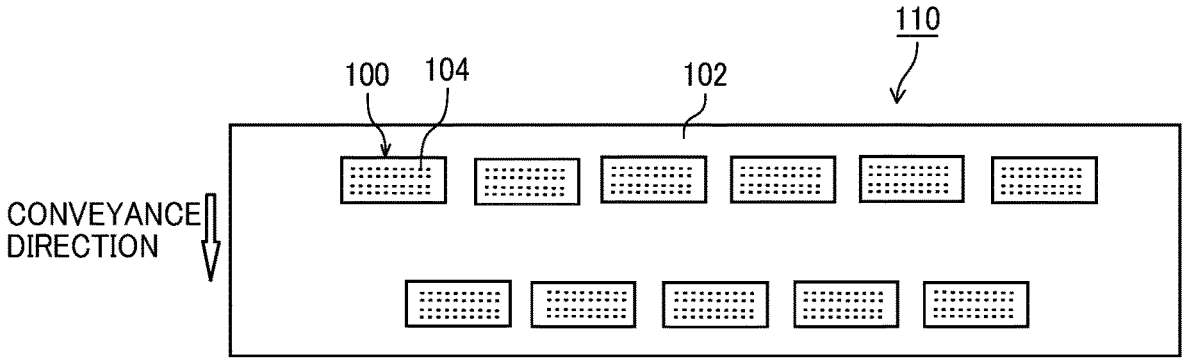
FIG. 2 is a plan view of an example of a discharge unit of the printer of FIG. 1.
Figure 3:
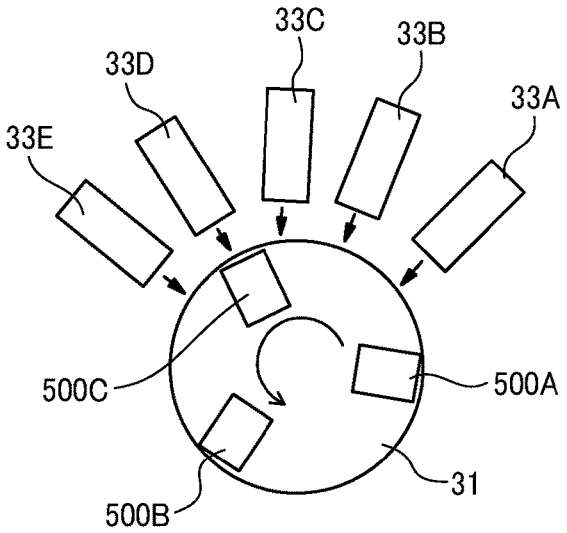
FIG. 3 is a schematic cross-sectional front view of the printer illustrating an arrangement of discharge receptacles of the printer.

Referring now to the drawings, wherein like reference numerals designate identical or corresponding parts throughout the several views, embodiments of the present disclosure are described below. A printer 1 as a liquid discharge apparatus according to a first embodiment of the present disclosure is described with reference to FIGS. 1 and 3. FIG. 1 is a schematic cross-sectional front view of the printer 1 according to the first embodiment of the present disclosure. FIG. 2 is a schematic plan view of a discharge unit of the printer 1. FIG. 3 is a schematic front view of a main part of a printing unit 30 of the printer 1 illustrating a discharge receptacle of the printer 1.

A printer 1 according to the first embodiment includes a loading unit 10 to load a sheet P into the printer 1, a pretreatment unit 20, a printing unit 30, a drying unit 40, and an ejection unit 50, and a reverse mechanism 60. In the printer 1, the pretreatment unit 20 applies, as required, pretreatment liquid onto the sheet P fed (supplied) from the loading unit 10, the printing unit 30 applies liquid to the sheet P to perform required printing, the drying unit 40 dries the liquid adhering to the sheet P, and the sheet P is ejected to the ejection unit 50.

The loading unit 10 includes loading trays 11 (a lower loading tray 11A and an upper loading tray 11B) to accommodate a plurality of sheets P and feeding units 12 (a feeding unit 12A and a feeding unit 12B) to separate and feed the sheets P one by one from the loading trays 11, and supplies the sheets P to the pretreatment unit 20.

The pretreatment unit 20 includes, e.g., a coater 21 as a treatment-liquid application unit that coats a printing surface of a sheet P with a treatment liquid having an effect of aggregation of ink particles to prevent bleed-through.

The printing unit 30 includes a drum 31 and a liquid discharge unit 32. The drum 31 is a bearer (rotating member) that bears the sheet P on a circumferential surface of the drum 31 and rotates. The liquid discharge unit 32 discharges a liquid toward the sheet P borne on the drum 31.

The printing unit 30 includes transfer cylinders 34 and 35. The transfer cylinder 34 receives the sheet P fed from the pretreatment unit 20 and forwards the sheet P to the drum 31. The transfer cylinder 35 receives the sheet P conveyed by the drum 31 and forwards the sheet P to the reverse mechanism 60.

The transfer cylinder 34 includes a sheet gripper to grip a leading end of the sheet P conveyed from the pretreatment unit 20 to the printing unit 30. The sheet P thus gripped is conveyed as the transfer cylinder 34 rotates. The transfer cylinder 34 forwards the sheet P to the drum 31 at a position opposite (facing) the drum 31.

Similarly, the drum 31 includes a sheet gripper on a surface of the drum 31, and the leading end of the sheet P is gripped by the sheet gripper of the drum 31. The drum 31 has a plurality of suction holes dispersedly on a surface of the drum 31, and a suction unit generates suction airflows directed to an interior of the drum 31 from the suction holes of the drum 31.

On the drum 31, the sheet gripper grips the leading end of the sheet P forwarded from the transfer cylinder 34, and the sheet P is attracted to and borne on the drum 31 by the suction airflows by the suction unit. As the drum 31 rotates, the sheet P is conveyed.

The liquid discharge unit 32 includes discharge units 33 (33A to 33E) to discharge liquids of each color, for example, yellow (Y), cyan (C), magenta (M), and black (K). For example, the discharge unit 33A discharges a liquid of black (K), the discharge unit 33B discharges a liquid of cyan (C), the discharge unit 33C discharges a liquid of magenta (M), and the discharge unit 33D discharges a liquid of yellow (Y), respectively. In addition, a discharge unit 33E is used to discharge a special liquid, that is, a liquid of spot color such as white, gold, or silver.

Each of the discharge units 33 (33A to 33E) includes a head array 110 (head module) as illustrated in FIG. 2, for example. The head array 110 includes a plurality of liquid discharge heads 100 arranged in a staggered manner on a base 102. Each of the plurality of liquid discharge heads 100 includes a plurality of nozzle rows (four rows in FIG. 2). Each of the plurality of nozzles rows in the liquid discharge head 100 includes a plurality of nozzles 104 arrayed in a longitudinal direction of the liquid discharge head 100 illustrated in FIG. 2.

The longitudinal direction of the liquid discharge head 100 is perpendicular to the conveyance direction of the sheet P indicated by arrow in FIG. 2. Hereinafter, the "liquid discharge head 100" is simply referred to as a "head 100." Each head 100 of the head array 110 includes a sub tank (liquid container) to store the liquid to be supplied to each of the head 100 of the head array 110.

The printer 1 controls the discharge operation of each of the discharge units 33 of the liquid discharge unit 32 by a drive signal corresponding to print data. When the sheet P borne on the drum 31 passes through a region facing the liquid discharge unit 32, the liquids of respective colors are discharged from the discharge units 33 toward the sheet P, and an image corresponding to the print data is formed on the sheet P.

Further, as illustrated in FIG. 3, the liquid discharge unit 32 includes a plurality of (here, three) discharge receptacles 500 (500A, 500B, and 500C) in the drum 31 arranged at substantially equal angles. The printing unit 30 performs a dummy discharge operation that controls the head 100 to discharge a liquid (dummy discharge liquid) not to be applied to the sheet P to the discharge receptacle 500 when the printing unit 30 maintains and recovers the head 100 of the discharge unit 33. The discharge receptacle 500 may receive the liquid overflown from the sheet P when the printer 1 performs a borderless printing.

The drying unit 40 dries the liquid adhered onto the sheet P by the printing unit 30. As a result, a liquid component such as moisture in the liquid evaporates, and the colorant contained in the liquid is fixed on the sheet P. Additionally, curling of the sheet P is restrained.

The reverse mechanism 60 reverses, in switchback manner, the sheet P that has passed through the drying unit 40 in double-sided printing. The reversed sheet P is fed back to the upstream side of the transfer cylinder 34 through a conveyance passage 61 of the printing unit 30.

The ejection unit 50 includes an ejection tray 51 on which a plurality of sheets P is stacked. The plurality of sheets P conveyed from the reverse mechanism 60 is sequentially stacked and held on the ejection tray 51.

Figure 4:
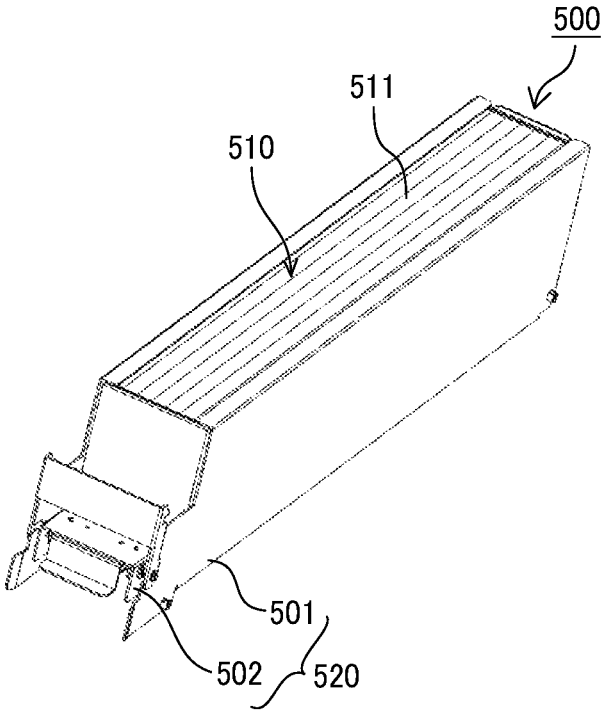
FIG. 4 is an outer perspective view of the discharge receptacle according to a first embodiment of the present disclosure.
Figure 5A:
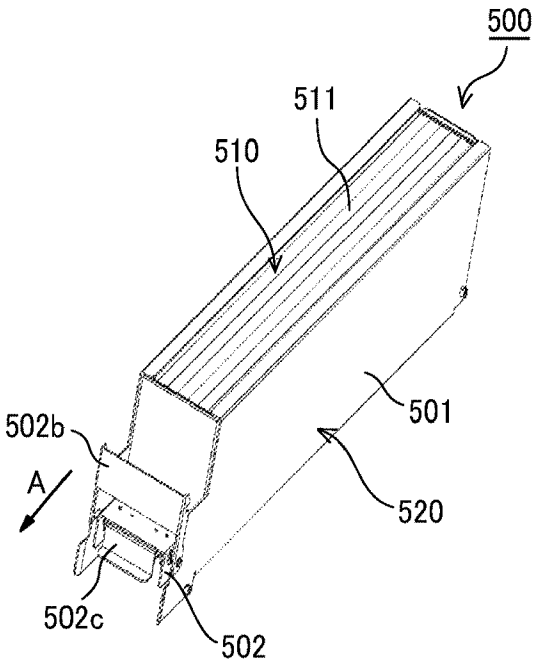
FIGS. 5A to 5C are perspective views of the discharge receptacle illustrating a replacement procedure of a liquid holder of the discharge receptacle.
Figure 5B:
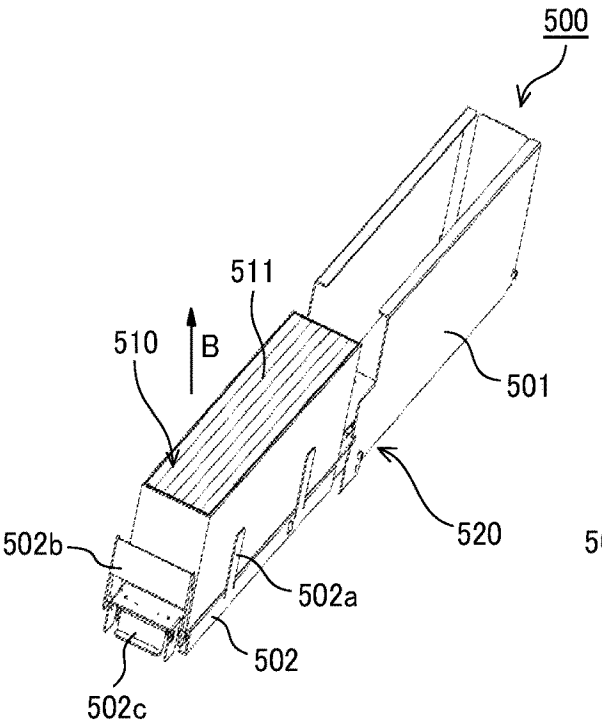
Figure 5C:
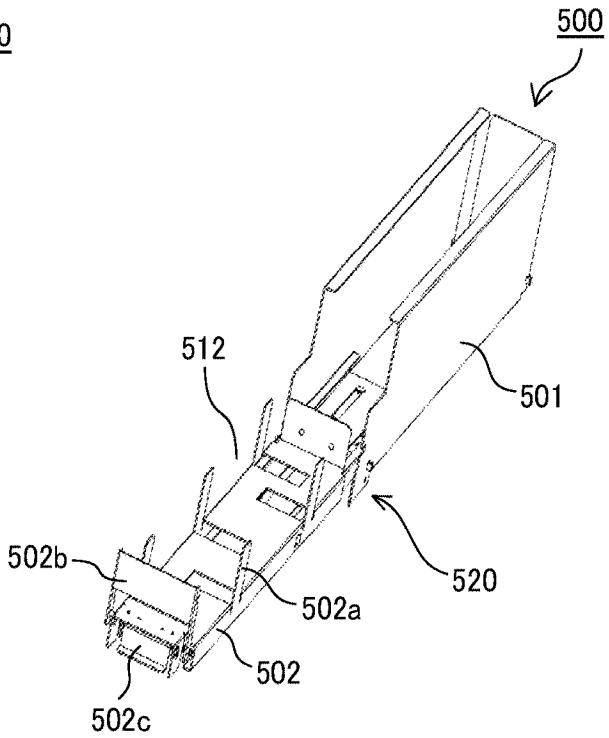

Next, the discharge receptacle 500 according to a first embodiment of the present disclosure is described with reference to FIG. 4 and FIGS. 5A to 5C. FIG. 4 is a schematic external perspective view of the discharge receptacle 500. FIGS. 5A to 5C are perspective views of a liquid holder 510 of the discharge receptacle 500 illustrating a replacement procedure of the liquid holder 510.

The discharge receptacle 500 includes a liquid holder 510 and a support 520. The liquid holder 510 receives and holds the liquid discharged from the head 100. The support 520 replaceably supports the liquid holder 510.

The liquid holder 510 includes one or a plurality of absorbers 511.

The support 520 is attached to the drum 31. The support 520 includes a support case 501 and a slider 502. The support case 501 serves as a support to accommodate the liquid holder 510. The slider 502 is slidably movable in an axial direction of the drum 31 with respect to the support case 501. The liquid holder 510 is detachably attached to the slider 502.

When a full detector of the printer 1 detects a full status of the liquid holder 510, the user can pull out the liquid holder 510 from the support 520 and replace the liquid holder 510.

As illustrated in FIG. 5A, the slider 502 as a part of the support 520 is pulled out from the support case 501 in a sliding direction indicated by arrow "A" to become a state illustrated in FIG. 5B to replace the liquid holder 510. The sliding direction is in a horizontal direction (leftward direction in FIG. 5A) and also in a longitudinal direction of the support case 501 in FIG. 5A.

As illustrated in FIG. 5B, when the slider 502 is pulled out from the support case 501, the liquid holder 510 is exposed while the liquid holder 510 is press-fitted into a plurality of press-fitting claws 502*a* on the slider 502. Therefore, the liquid holder 510 is pulled out in a direction indicated by arrow "B" (vertically upward direction in FIG. 5B), and the liquid holder 510 is removed from the slider 502.

Then, as illustrated in FIG. 5C, a new liquid holder 510 is set to an empty slider 502. The slider 502 is returned to an interior of the support case 501 and becomes (returns to) the state as illustrated in FIG. 4.

As described above, the discharge receptacle 500 in the first embodiment includes the liquid holder 510 detachably attached to the support 520. Only the liquid holder 510 is replaceable in the discharge receptacle 500.

Figure 6A:
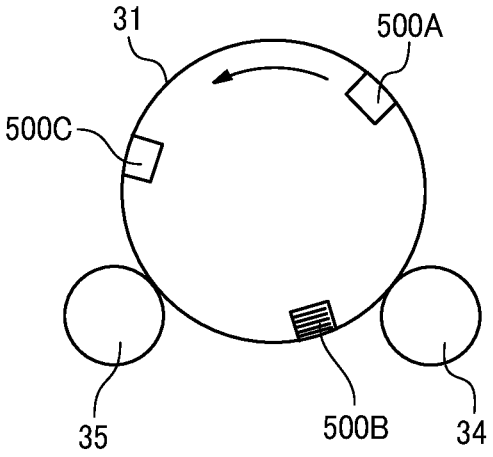
FIGS. 6A and 6B are schematic cross-sectional front views of the drum illustrating a rotation operation of the drum when the liquid holder is full.
Figure 6B:
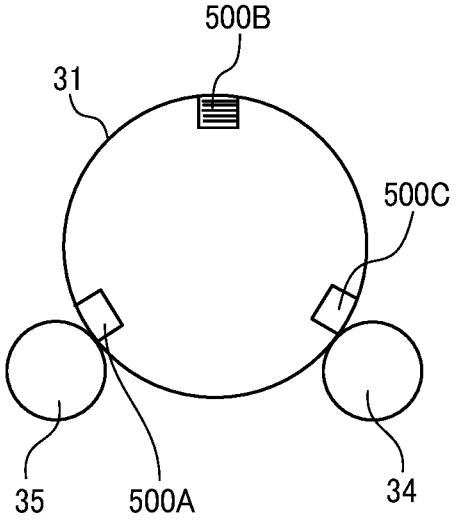

Next, a rotation control of the drum 31 when replacing the liquid holder 510 is described with reference to FIGS. 6A and 6B. FIGS. 6A and 6B are schematic cross-sectional side views of the drum 31 illustrating a rotation operation of the drum 31 when the liquid holder 510 is full.

When the full detector of the printer 1 detects the full status of the liquid holder 510, a controller of the printer 1 controls the drum 31 to rotate to replace the liquid holder 510 of the discharge receptacle 500.

Specifically, the controller rotationally drives the drum 31 to move the discharge receptacle 500, the liquid holder 510 of which is full, to a specified position. Then, the controller indicates a full status of the discharge receptacle 500 in a control panel of the printer 1. The specified position is a position at which the opening of the support 520 faces upward. For example, the position is at a vertical top of an axis of the drum 31.

For example, if the liquid holder 510 of the discharge receptacle 500B is full as illustrated in FIG. 6A, the controller rotationally drives the drum 31 so that the discharge receptacle 500B positions at a vertical top of the drum 31 as illustrated in FIG. 5B.

Thus, the discharge receptacle 500 is moved to a position at which an opening 512 of the support 520 of the discharge receptacle 500B faces upward as illustrated in FIG. 6B. Thus, it is possible to prevent the liquid held in the absorbers 511 of the liquid holder 510 from being dropped out of the discharge receptacle 500 when the liquid holder 510 is replaced.

At the time when the opening 512 of the support 520 faces upward, the liquid holder 510 is replaced while the discharge receptacle 500 is positioned near the top of the drum 31 in the vertical direction. In a case in which the printer 1 is a large-sized printing apparatus, a diameter of the drum 31 may exceed 1 m, and the top of the drum 31 may be located near the eyes of a person.

Further, in the large-sized printing apparatus, a large amount of liquid is discharged to the liquid holder 510 due to dummy discharge operation or the like. Thus, a large-capacity discharge receptacle 500 is often installed on the drum 31 to reduce a frequency of replacement of the liquid holder 510. Therefore, a weight of the liquid holder 510 absorbing the liquid becomes several Kg to ten and several Kg. Thus, it is not easy to replace the heavy liquid holder 510 at a high position, and workability of replacement of the liquid holder 510 may be deteriorated.

Next, a support structure of the discharge receptacle 500 according to a first embodiment of the present disclosure is described with reference to FIG. 7. FIGS. 7A to 7D are schematic cross-sectional side views of the support structure of the discharge receptacle 500 illustrating a replacement procedure of the liquid holder 510.

The support 520 of the discharge receptacle 500 is supported between the side plates 311 (311A and 311B) on both sides of the drum 31 in the axial direction of the drum 31. The drum 31 is a rotating body to convey the sheet P. As described above, the drum 31 includes a plurality of discharge receptacles 500 in a circumferential direction of the drum 31 as a rotating body. Specifically, the plurality of discharge receptacles 500 is disposed inside the drum 31 (rotating body) around a circumference of the drum 31 (rotating body).

FIGS. 7A to 7D illustrate the discharge receptacle 500 located at the top of the drum 31 in the vertical direction when the discharge receptacle 500 is full.

The drum 31 includes a holder 521 on the side plate 311B. The holder 521 includes a support shaft 521*a* to support one end of the support case 501 of the discharge receptacle 500 so that the support case 501 is rotatable about the support shaft 521*a*. Thus, the support case 501 is rotatable in a radial direction of the drum 31. Thus, the holder 521 rotatably supports one end of the discharge receptacle 500. That is, the drum 31 (rotating body) includes side plates 311A and 311B to support the discharge receptacle 500, and one of the side plates 311B rotatably supports one end of the support 520 of the discharge receptacle 500.

The drum 31 includes a latching pin 312 on the side plate 311A. The discharge receptacle 500 includes a latching hook 502*b* on another end of the support case 501 of the discharge receptacle 500. The latching hook 502*b* is engageable with a latching pin 312 on the side plate 311A. The latching pin 312 and the latching hook 502*b* configure a latching part removably latched to another end of the discharge receptacle 500 at an installation position. The latching hook 502*b* is on a handle 502*c* that is rotatably held by the slider 502 (see FIG. 7C).

Figure 7A:
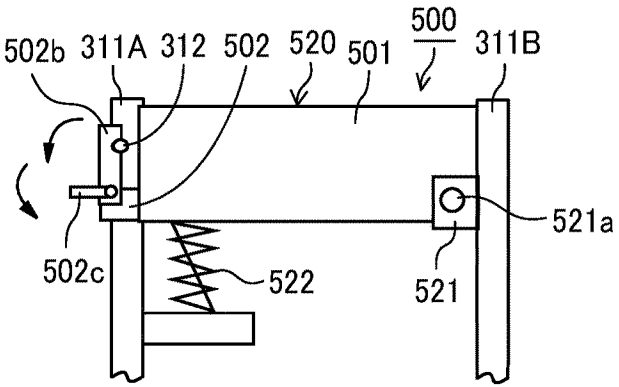
FIGS. 7A to 7D are schematic cross-sectional side views of a support structure of the discharge receptacle according to the first embodiment illustrating a replacement procedure of the liquid holder.

When the latching hook 502*b* is engaged with the latching pin 312, the discharge receptacle 500 is supported at the installation position at which the liquid holder 510 receives the liquid as illustrated in FIG. 7A.

Figure 7B:
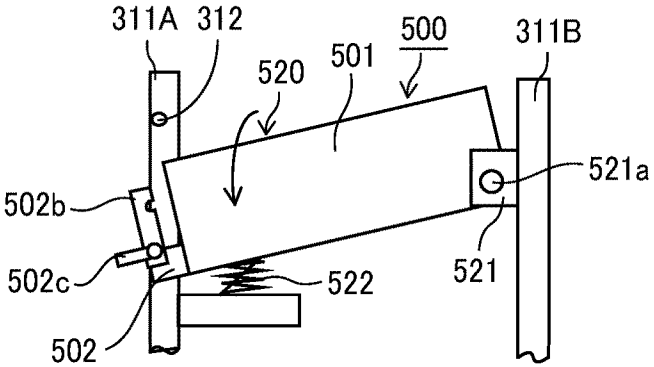

Then, when the latching hook 502*b* is disengaged from the latching pin 312, the discharge receptacle 500 is displaced (rotated) by its own weight to a detachment position below the installation position as illustrated in FIG. 7B. The liquid holder 510 is detachably attached to the support 520 at the installation position. Thus, the support case 501 is inclined obliquely downward such that another end (left end in FIG. 7B) of the support case 501 becomes lower than the one end (right end in FIG. 7B) of the support case 501.

Thus, the slider 502 can be pulled out from the support case 501 of the support 520 of the discharge receptacle 500 to replace the liquid holder 510 as described above.

The discharge receptacle 500 includes a compression spring 522 as an elastic member arranged on the side plate 311A to apply a force in an upward direction opposite to a displacement direction of the discharge receptacle 500 displaced downward by its own weight. The compression spring 522 can prevent another end of the discharge receptacle 500 from swinging downward with momentum and damaging the discharge receptacle 500 by an impact. Another end of the discharge receptacle 500 includes the handle 502*c* to be pulled out during the replacement procedure.

The device to apply a force in a direction opposite to a displacement direction of the discharge receptacle 500 is not limited to the compression spring 522. The device may be, for example, a tension spring or a torsion coil spring on the support shaft 521*a* of the holder 521. Further, the support shaft 521*a* of the holder 521 may include a torque limiter or the like.

The replacement procedure of the liquid holder 510 according to the first embodiment is described below.

When the control panel of the printer 1 indicates that the liquid holder 510 is full, the replacement procedure to replace the liquid holder 510 with a new liquid holder 510 is performed as described below.

First, as illustrated in FIG. 7A, the handle 502*c* of the slider 502 of the discharge receptacle 500 is pushed downward in a direction indicated by arrow in FIG. 7A. The discharge receptacle 500 as a target to be replaced is located at the top of the drum 31 in the vertical direction.

Thus, the latching hook 502*b* of the slider 502 rotates in a direction indicated by the arrow and is disengaged from the latching pin 312 on the side plate 311A of the drum 31.

The holder 521 on the drum 31 rotatably holds one end of the discharge receptacle 500. Therefore, the latching hook 502*b* is disengaged from the latching pin 312, and another end of the discharge receptacle 500 rotates to move downward about the support shaft 521*a* of the holder 521 as illustrated in FIG. 7B. Thus, the discharge receptacle 500 is displaced (rotated) downward from the installation position to the detachment position by its own weight while the discharge receptacle 500 receives the force applied upward by the compression spring 522. The discharge receptacle 500 including the liquid holder 510 is inclined obliquely downward.

Then, the discharge receptacle 500 slowly and obliquely rotates and displaces downward by its own weight due to a buffering action of the compression spring 522 (auxiliary spring) that applies a force in a direction opposite to the displacement direction of the discharge receptacle 500 by its own weight.

Figure 7C:
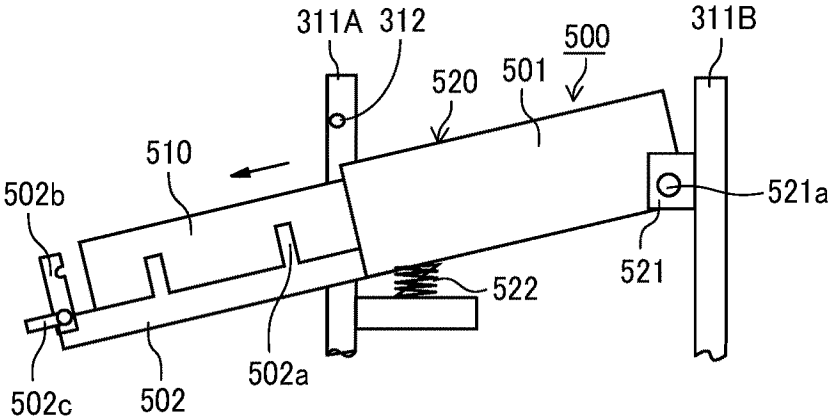

Next, as illustrated in FIGS. 7B and 7C, the user can directly operate the handle 502*c* of the slider 502 to pull out the slider 502 from the support case 501 in the longitudinal direction of the support case 501 indicated by arrow in FIG. 7C to expose the liquid holder 510.

Figure 7D:
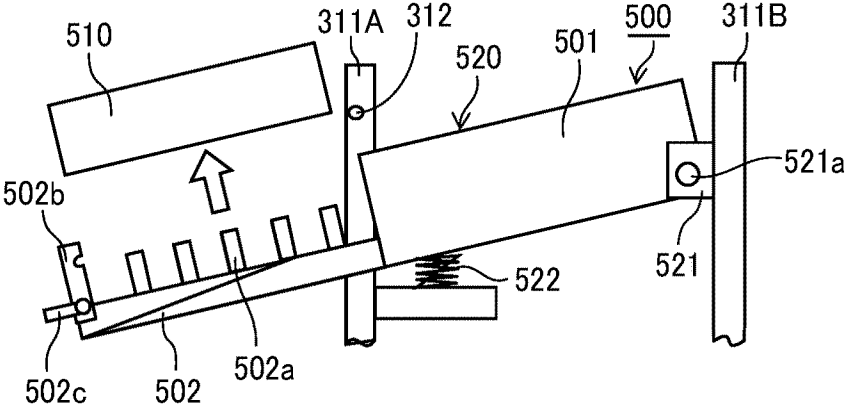

Then, as illustrated in FIG. 7D, the liquid holder 510 is pulled out from the slider 502 in an upward direction indicated by arrow in FIG. 7D to remove the liquid holder 510 from the slider 502. Then, a new liquid holder 510 is press-fitted and attached to the slider 502, and then the slider 502 is pushed into the support case 501.

The handle 502*c* is moved upward so that the latching hook 502*b* is engaged again with the latching pin 312. Thus, the discharge receptacle 500 is returned to the installation position from the detachment position as illustrated in FIG. 7A.

At the time of returning to the installation position of the discharge receptacle 500, the compression spring 522 assists the user to push the discharge receptacle 500 upward so that the user can push (lift) the discharge receptacle 500 upward with a light force.

Thus, the discharge receptacle 500 has a configuration in which the discharge receptacle 500 is rotationally displaced from the installation position to the detachment position lower than the installation position to pull out the liquid holder 510 in a direction obliquely downward as illustrated in FIG. 7C. Thus, the liquid holder 510 of the discharge receptacle 500 is displaceable to the detachment position lower than the installation position so that the user can easily replace the liquid holder 510 in the discharge receptacle 500.

Therefore, even when the specified installation position of the discharge receptacle 500 (the position illustrated in FIG. 6B) is high and is difficult to replace the liquid holder 510, the liquid holder 510 is movable to the detachment position lower than the installation position to be replaced. Thus, the replacement of the liquid holder 510 becomes easier.

The discharge receptacle 500 is displaced to be obliquely downward, and the slider 502 is pulled outside the support case 501 in a direction obliquely downward. Thus, the slider 502 pulled out in the direction obliquely downward can be pulled out with smaller force than the slider 502 pulled out horizontally. Further, the liquid holder 510 is pulled outside the drum 31 so that the user can easily access the liquid holder 510 to replace the liquid holder 510.

Figure 8B:
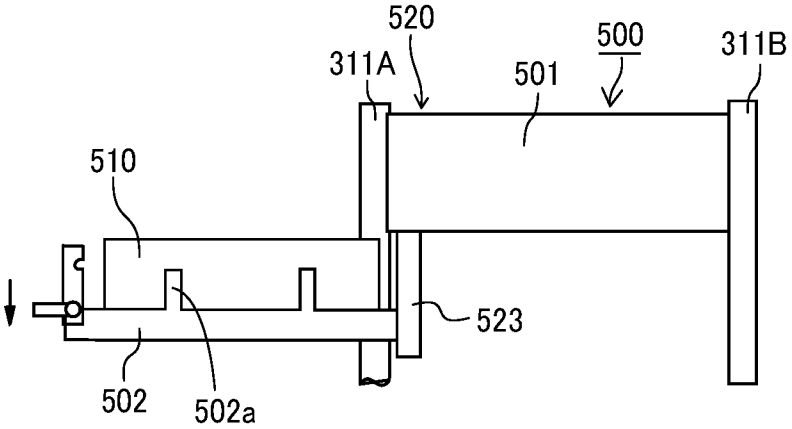
FIGS. 8A and 8B are schematic cross-sectional side views of the support structure of the discharge receptacle according to a second embodiment illustrating the replacement procedure of the liquid holder.
Figure 8A:
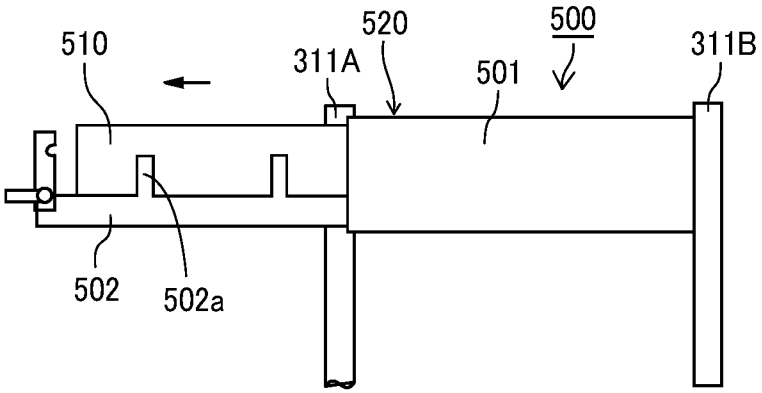

Next, the discharge receptacle 500 according to a second embodiment of the present disclosure is described with reference to FIGS. 8A and 8B. FIGS. 8A and 8B are schematic cross-sectional side views of the support structure of the discharge receptacle 500 according to the second embodiment illustrating a replacement procedure of the liquid holder 510.

The discharge receptacle 500 according to the second embodiment includes the slider 502 that is horizontally slidably accommodated into the support case 501 and an elevation mechanism 523 vertically movably hold the slider 502. The elevation mechanism 523 serves as an elevator. Thus, the slider 502 may be slid into the support case 501 to be accommodated inside the support case 501.

Further, the slider 502 may be slidably pulled out from the support case 501. The elevation mechanism 523 (elevator) lowers the slider 502 to the detachment position in a state in which the slider 502 is pulled out from the support case 501.

Further, the slider 502 as a part of the support 520 is displaceable in the radial direction of the drum 31.

To replace the liquid holder 510 in the second embodiment, the liquid holder 510 is pulled out from the support case 501 together with the slider 502 in a horizontal direction from the installation position of the discharge receptacle 500 at which the liquid holder 510 receives the liquid discharged from the head 100 as illustrated in FIG. 8A.

Then, as illustrated in FIG. 8B, the elevation mechanism 523 in the discharge receptacle 500 is used to lower the slider 502 to the detachment position below the installation position.

Then, the liquid holder 510 that is full is removed from the slider 502, and a new liquid holder 510 is mounted (set) on the slider 502. Then, the slider 502 is raised to the installation position and is accommodated inside the support case 501.

Thus, the slider 502 is displaced from the installation position to the detachment position to easily replace the liquid holder 510. The slider is a part of the support 520 of the discharge receptacle 500. The liquid holder 510 receives the liquid discharged from the head 100 at the installation position. The detachment position is lower than the installation position and is a position at which the liquid holder 510 is detachably attached.

Further, the discharge receptacle 500 in the second embodiment does not use an area inside the drum 31 during replacement of the liquid holder 510. Thus, components other than the discharge receptacle 500 can be arranged in the area inside the drum 31. The above-described discharge receptacle 500 in the first embodiment does not use an area in front of the drum 31. Thus, the discharge receptacle 500 in the first embodiment does not need components such as a frame to support the drum 31.

Thus, the liquid holder 510 is easily replaceable in both of the discharge receptacles 500 in the first embodiment and the second embodiment. Since the liquid holder 510 is easily replaceable in the discharge receptacle 500 according to the first embodiment and the second embodiment, the configuration of the drum 31 may be selected from a layout of other components.

Next, the discharge receptacle 500 according to a third embodiment of the present disclosure is described with reference to FIG. 9. FIGS. 9A and 9B are schematic cross-sectional side views of the support structure of the discharge receptacle 500 according to the third embodiment illustrating a replacement procedure of the liquid holder 510.

Figure 9B:
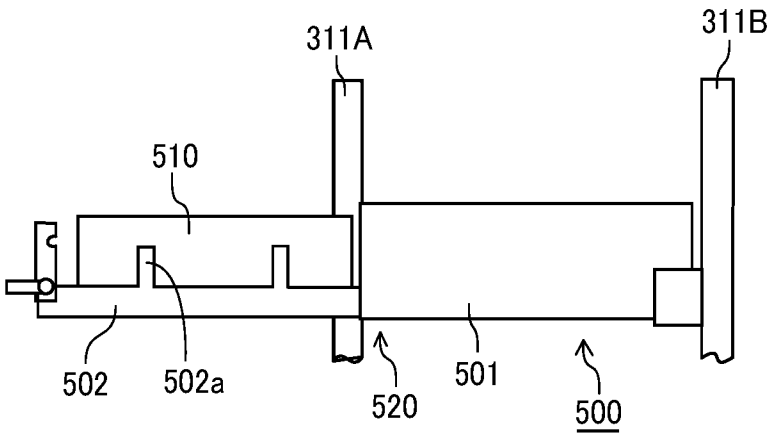
FIGS. 9A and 9B are schematic cross-sectional side views of the support structure of the discharge receptacle according to a third embodiment illustrating the replacement procedure of the liquid holder.
Figure 9A:
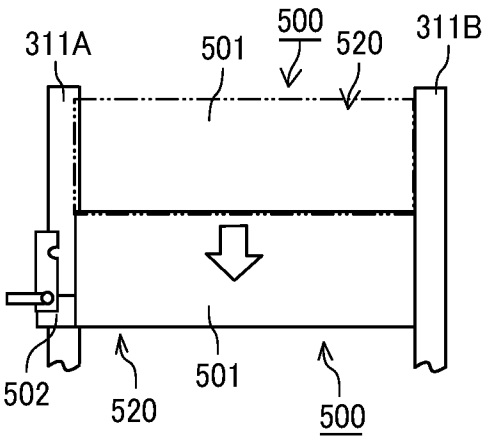

The discharge receptacle 500 in the third embodiment is displaceably supported between the side plates 311A and 311B of the drum 31 from the installation position to the detachment position as illustrated in FIGS. 9A and 9B. The detachment position indicated by an imaginary line is lower than the installation position indicated by a solid line as illustrated in FIG. 9A. More specifically, the discharge receptacle 500 is vertically displaced in parallel with the side plate 311A and the side plate 311B of the drum 31 as indicated by arrow in FIG. 9A. Thus, the discharge receptacle 500 is movable parallel to the side plates 311A and 311B from the installation position to the detachment position.

To replace the liquid holder 510, the discharge receptacle 500 is displaced inside the drum 31 from the installation position indicated by the imaginary line to the detachment position indicated by the solid line below the installation position as illustrated in FIG. 9A.

Then, the liquid holder 510 is horizontally pulled out from the support case 501 of the discharge receptacle 500 together with the slider 502 as illustrated in FIG. 9B. Then, the liquid holder 510 that is full is removed upward from the slider 502, and a new liquid holder 510 is mounted (set) on the slider 502. Then, the slider 502 is pushed inside the support case 501 to be accommodated inside the support case 501.

Then, the discharge receptacle 500 is raised to the installation position at which the liquid holder 510 receives the liquid discharged from the head 100 as indicated by the imaginary line in FIG. 9A.

The discharge receptacle 500 according to the third embodiment uses a large area in the drum 31. However, a large area in front of the drum 31 is provided in the discharge receptacle 500 according to the third embodiment. Further, a descension of the discharge receptacle 500 is controlled to be completed at a stage in which the control panel displays an indication that the liquid holder 510 is full. Thus, the user can move the liquid holder 510 to the detachment position simply by pulling the liquid holder 510 horizontally. Thus, the user can easily replace the liquid holder 510 in the discharge receptacle 500.

Figure 10:
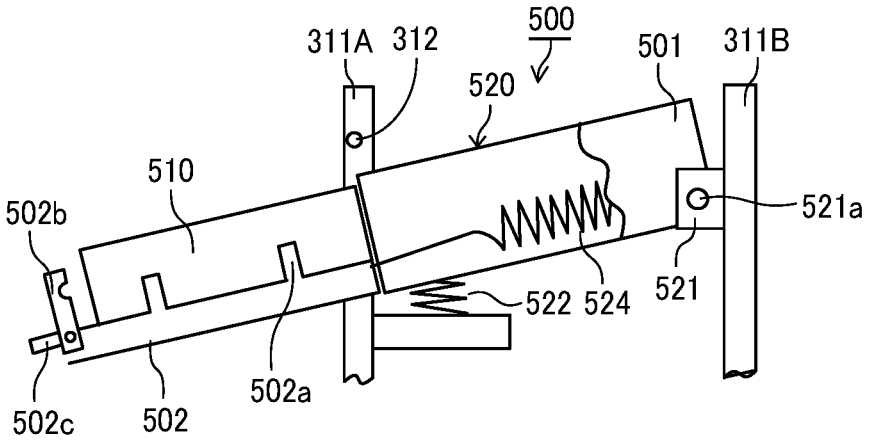
FIG. 10 is a schematic cross-sectional side view of the support structure of the discharge receptacle according to a fourth embodiment.

Next, the discharge receptacle according to a fourth embodiment of the present disclosure is described with reference to FIG. 10. FIG. 10 is a schematic cross-sectional side view of the support structure of the discharge receptacle 500 according to the fourth embodiment.

The slider 502 of the support 520 of the discharge receptacle 500 includes a member having a high sliding ability (movability) with respect to the support case 501 such as a slide rail member.

Thus, when the discharge receptacle 500 is tilted obliquely downward, the slider 502 is automatically pulled out (ejected) obliquely downward due to the weight of the liquid holder 510 and the slider 502. Thus, a tilting movement of the support case 501 of the discharge receptacle 500 moves the slider 502 outside the support case 501 from the installation position to the detachment position by the weight of the slider 502.

Thus, a simple removal of the latching hook 502*b* of the discharge receptacle 500 from the latching pin 312 can displace the support 520 to the detachment position. Thus, the slider 502 is automatically pulled out from the support case 501 to improve operability of a replacement process of the liquid holder 510.

Further, the discharge receptacle 500 in the fourth embodiment includes an elastic member such as a tension spring 524 to apply a resistance force to a movement of the slider 502 in an obliquely downward direction. Thus, the elastic member such as the tension spring 524 serves as a resistance to apply the resistance force to a movement of the slider 502.

Thus, the tension spring 524 can prevent the slider 502 from jumping out of the support case 501 of the support 520 when the discharge receptacle 500 is tilted. The slider 502 supports the liquid holder 510.

Further, the tension spring 524 also functions as an auxiliary pushing member to push the slider 502 into the support case 501 after the liquid holder 510 is replaced. Thus, the discharge receptacle 500 in the fourth embodiment can improve the operability of replacement of the liquid holder 510.

The elastic member is not limited to the tension spring 524 but also a compression spring or the like that applies a resistance force to the movement of the slider 502 when the slider 502 is pulled out and also assists the slider 502 to be pushed into the support case 501.

Further, when the slider 502 is pushed into the support case 501, the liquid holder 510 is basically in a new state after replacement. Thus, weight of the liquid holder 510 that is in the new state is light and can be pushed into the support case 501 with a small force.

Therefore, a member to assist the slider 502 to be pushed into the support case 501 is not necessarily the elastic member such as the tension spring 524 that resists the slider 502 to be pulled out from the support case 501 and assists the slider 502 to be pushed into the support case 501. For example, the discharge receptacle 500 may include a brake on the slider 502. The brake reduces a speed of a movement of the slider 502 in a direction diagonally downward by the weight of the slider 502.

Figure 11:
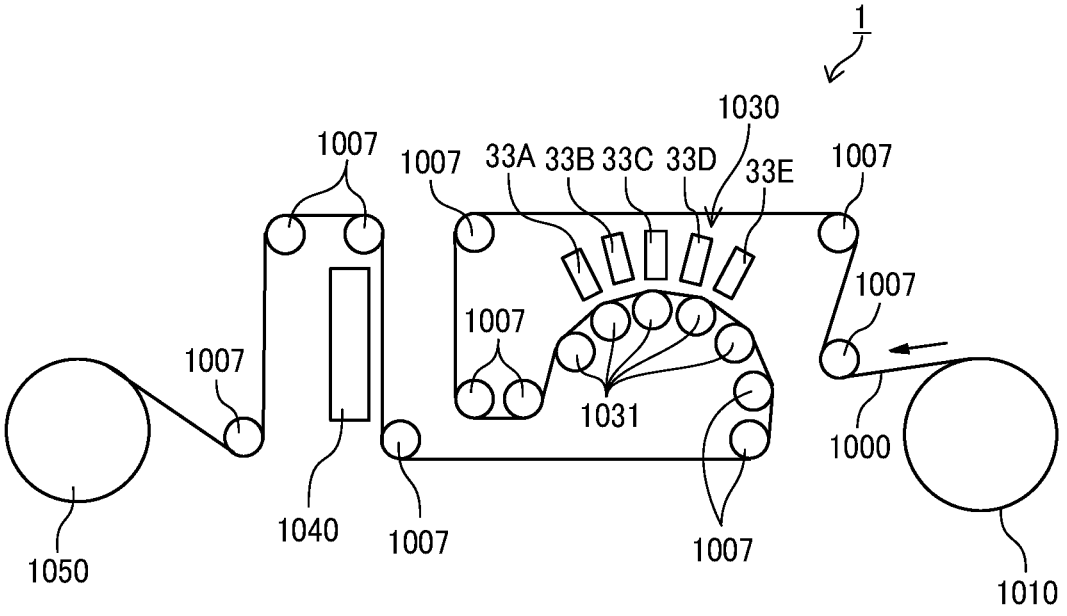
FIG. 11 is a schematic cross-sectional front view of the printer as a liquid discharge apparatus according to a fifth embodiment of the present disclosure.

Next, the printer 1 as the liquid discharge apparatus according to a fifth embodiment of the present disclosure is described with reference to FIG. 11. FIG. 11 is a schematic cross-sectional front view of the printer 1 according to the fifth embodiment of the present disclosure.

The printer 1 guides a web 1000 such as a continuous sheet as the sheet P fed from a feeding roll 1010 to a printing unit 1030 via a plurality of guide rollers 1007. The printing unit 1030 includes a plurality of guide rollers 1031 to guide the web 1000 while the web 1000 faces each discharge unit 33. The printing unit 1030 includes the discharge units 33, and each of the discharge units 33 discharges a desired liquid from the nozzles 104 of the heads 100 onto the web 1000 to print desired image on the web 1000.

Then, the dryer 1040 dries a print surface of the web 1000, onto which the image has been printed by the printing unit 1030, while guiding the web 1000 by the plurality of guide rollers 1007. The web 1000 dried by the dryer 1040 is wound around a winding roller 1050.

Figure 12:
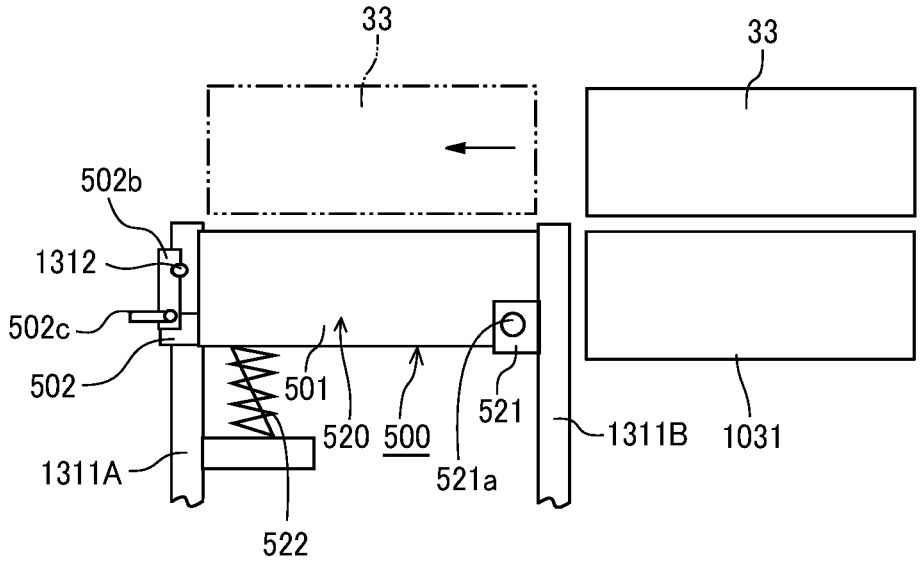
FIG. 12 is a schematic cross-sectional side view of the support structure of the discharge receptacle according to the fifth embodiment.

Next, a support structure of the discharge receptacle 500 of the printer 1 according to the fifth embodiment of the present disclosure is described with reference to FIG. 12. FIG. 12 is a schematic cross-sectional side view of the support structure of the discharge receptacle 500 according to the fifth embodiment.

The printer 1 according to the fifth embodiment includes the discharge unit 33 that is movable with respect to the discharge receptacle 500. The discharge receptacle 500 is supported between the side plates 1311A and 1311B.

The support structure of the discharge receptacle 500 is the same as the support structure described in the first embodiment illustrated in FIGS. 7A to 7D. One end of the support 520 is rotatably supported by a support shaft 521*a* on the side plate 1311B, and another end of the support 520 is held (latched) by the latching pin 1312 on the side plate 1311A that engages with the latching hook 502*b* of the discharge receptacle 500.

The replacement procedure of the liquid holder 510 in the discharge receptacle 500 according to the fifth embodiment (see FIG. 12) is similar to the replacement procedure of the liquid holder 510 in the discharge receptacle 500 according to the first embodiment (see FIGS. 7A to 7D).

The discharge receptacle 500 according to the fifth embodiment also can replace the liquid holder 510 at the detachment position below the installation position to receive the liquid discharged from the head 100. Thus, the discharge receptacle 500 according to the fifth embodiment can improve operability of replacement of the liquid holder 510.

Figure 13A:
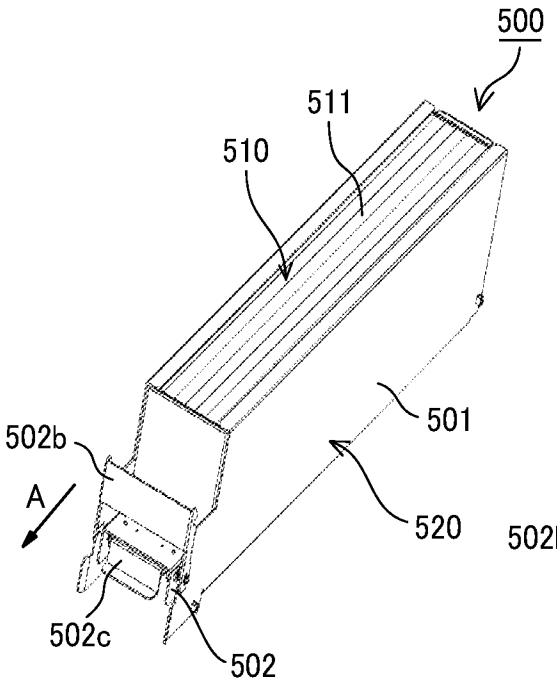
FIGS. 13A to 13C are schematic perspective views of the discharge receptacle according to a sixth embodiment of the present disclosure.
Figure 13B:
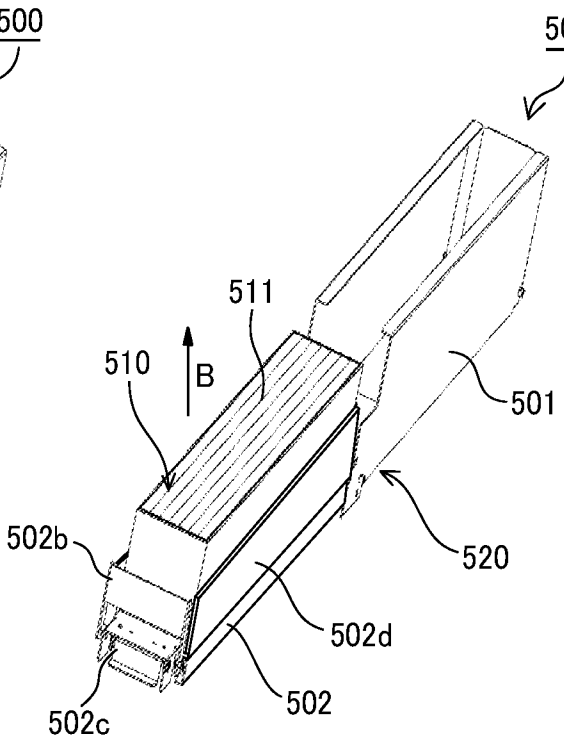
Figure 13C:
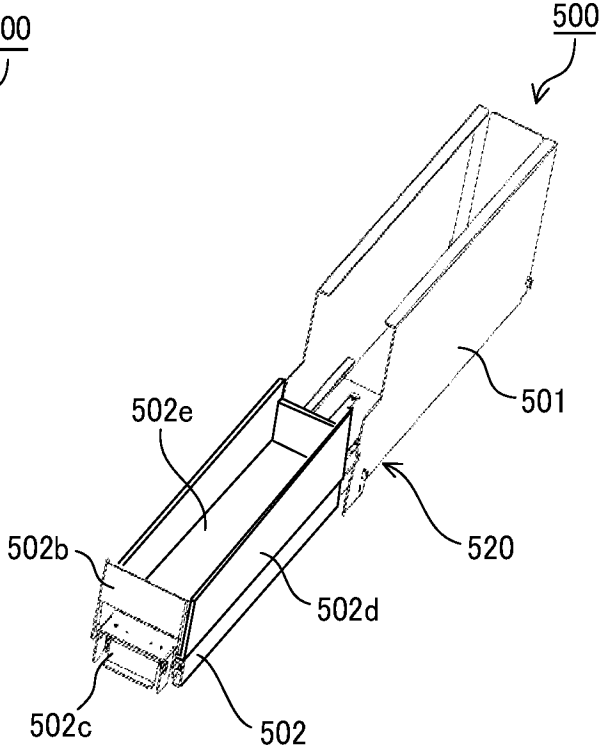
Figure 14:
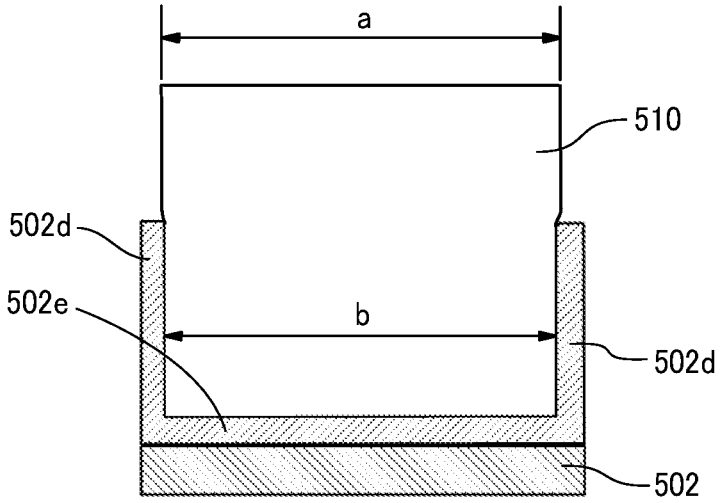
FIG. 14 is a cross-sectional side view of a slider of the discharge receptacle according to the sixth embodiment.

Next, the discharge receptacle 500 according to a sixth embodiment of the present disclosure is described with reference to FIGS. 13A to 13C and FIG. 14. FIGS. 13A to 13C are schematic perspective views of the discharge receptacle 500 according to the sixth embodiment. FIG. 14 is a cross-sectional side view of the slider 502 of the discharge receptacle 500 according to the sixth embodiment.

The slider 502 includes walls 502*d* that covers side surfaces of the liquid holder 510. The walls 502*d* are along a longitudinal direction of the liquid holder 510. The walls 502*d* are respectively arranged on two side surfaces of the liquid holder 510 as illustrated in FIG. 14. The walls 502*d* are formed by bending a single plate material. A bottom surface 502*e* of the single plate material is fixed to an upper surface of the slider 502. Remaining parts of the single plate material becomes the walls 502*d*.

Further, a length "a" in a transverse direction of the liquid holder 510 is set to be larger than a distance "b" between the opposing walls 502*d*. The transverse direction of the liquid holder 510 is perpendicular to the longitudinal direction of the liquid holder 510. Therefore, the liquid holder 510 is set to a space between the walls 502*d* such that the liquid holder 510 is pressed into the space between the walls 502*d*. The slider 502 having such a configuration can increase a holding force of the slider 502 to hold the liquid holder 510.

The walls 502*d* having a wide surface can increase strengths of the walls 502*d*.

Further, the walls 502*d* covering four sides of the liquid holder 510 can increase the holding force of the slider 502 to hold the liquid holder 510.

Figure 15:
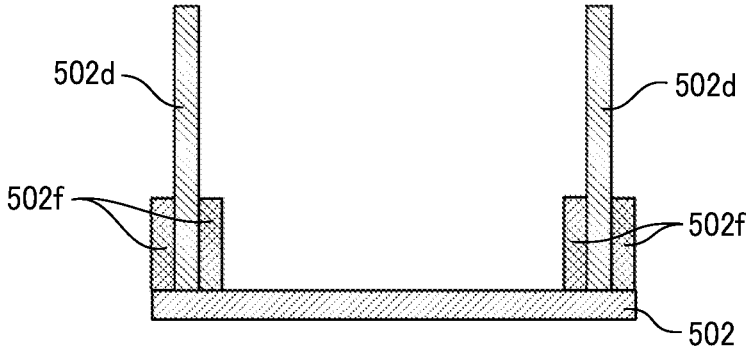
FIG. 15 is a cross-sectional side view of the slider of the discharge receptacle according to a seventh embodiment.

Next, the discharge receptacle 500 according to a seventh embodiment of the present disclosure is described with reference to FIG. 15. FIG. 15 is a cross-sectional side view of a discharge receptacle 500 of the head 100 according to the seventh embodiment.

The slider 502 according to the seventh embodiment includes walls 502*d* that respectively cover side surfaces of the liquid holder 510 of the slider 502. The walls 502*d* are press-fitted and fixed to insertion portions 502*f* of the slider 502. The walls 502*d* may be fixed to insertion portions 502*f* of the slider 502 by a screw or the like in a state in which the walls 502*d* are fitted to the insertion portions 502*f* of the slider 502.

Even with such a configuration, the slider 502 can increase a holding force of the slider 502 to hold the liquid holder 510 as similar to the discharge receptacle 500 according to the sixth embodiment.

In the present embodiments, a "liquid" discharged from the head is not particularly limited as long as the liquid has a viscosity and surface tension of degrees dischargeable from the head. However, preferably, the viscosity of the liquid is not greater than 30 mPa·s under ordinary temperature and ordinary pressure or by heating or cooling.

Examples of the liquid include a solution, a suspension, or an emulsion that contains, for example, a solvent, such as water or an organic solvent, a colorant, such as dye or pigment, a functional material, such as a polymerizable compound, a resin, or a surfactant, a biocompatible material, such as DNA, amino acid, protein, or calcium, or an edible material, such as a natural colorant.

Such a solution, a suspension, or an emulsion can be used for, e.g., inkjet ink, surface treatment solution, a liquid for forming components of electronic element or light-emitting element or a resist pattern of electronic circuit, or a material solution for three-dimensional fabrication.

Examples of an energy source to generate energy to discharge liquid include a piezoelectric actuator (a laminated piezoelectric element or a thin-film piezoelectric element), a thermal actuator that employs a thermoelectric conversion element, such as a heating resistor, and an electrostatic actuator including a diaphragm and opposed electrodes.

Examples of the "liquid discharge apparatus" include, not only apparatuses capable of discharging liquid to materials to which liquid can adhere, but also apparatuses to discharge a liquid toward gas or into a liquid.

The "liquid discharge apparatus" may include devices to feed, convey, and eject the material onto which liquid can adhere. The liquid discharge apparatus may further include a pretreatment apparatus to coat a treatment liquid onto the material, and a post-treatment apparatus to coat a treatment liquid onto the material, onto which the liquid has been discharged.

The "liquid discharge apparatus" may be, for example, an image forming apparatus to form an image on a sheet by discharging ink, or a three-dimensional fabrication apparatus to discharge a fabrication liquid to a powder layer in which powder material is formed in layers to form a three-dimensional fabrication object.

The "liquid discharge apparatus" is not limited to an apparatus to discharge liquid to visualize meaningful images, such as letters or figures. For example, the liquid discharge apparatus may be an apparatus to form arbitrary images, such as arbitrary patterns, or fabricate three-dimensional images.

The above-described term "material onto which liquid can adhere" represents a material on which liquid is at least temporarily adhered, a material on which liquid is adhered and fixed, or a material into which liquid is adhered to permeate. Examples of the "material onto which liquid can adhere" include recording media, such as paper sheet, recording paper, recording sheet of paper, film, and cloth, electronic component, such as electronic substrate and piezoelectric element, and media, such as powder layer, organ model, and testing cell. The "material onto which liquid can adhere" includes any material on which liquid is adhered, unless particularly limited.

Examples of the "material onto which liquid can adhere" include any materials on which liquid can adhere even temporarily, such as paper, thread, fiber, fabric, leather, metal, plastic, glass, wood, and ceramic.

The "liquid discharge apparatus" may be an apparatus to relatively move the head and a material onto which liquid can adhere. However, the liquid discharge apparatus is not limited to such an apparatus. For example, the liquid discharge apparatus may be a serial head apparatus that moves the head or a line head apparatus that does not move the head.

Examples of the "liquid discharge apparatus" further include a treatment liquid coating apparatus to discharge a treatment liquid to a sheet to coat the treatment liquid on a sheet surface to reform the sheet surface, and an injection granulation apparatus in which a composition liquid including raw materials dispersed in a solution is injected through nozzles to granulate fine particles of the raw materials.

The terms "image formation", "recording", "printing", "image printing", and "fabricating" used herein may be used synonymously with each other.

Numerous additional modifications and variations are possible in light of the above teachings. It is therefore to be understood that, within the scope of the above teachings, the present disclosure may be practiced otherwise than as specifically described herein. With some embodiments having thus been described, it is obvious that the same may be varied in many ways. Such variations are not to be regarded as a departure from the scope of the present disclosure and appended claims, and all such modifications are intended to be included within the scope of the present disclosure and appended claims.

What is claimed is:

1. A liquid discharge apparatus comprising:
a head configured to discharge a liquid; and
a discharge receptacle configured to receive the liquid discharged from the head at an installation position,
wherein the discharge receptacle includes:
a liquid holder configured to receive the liquid discharged from the head; and
a support comprising a support case, and a slider configured to be slidably accommodated into the support case and detachably hold the liquid holder,
at least a part of the support is displaceable to a detachment position at which the liquid holder is detachable from the support,
the detachment position is lower than the installation position, and
the support case is configured to tilt to move the slider outside the support case from the installation position to the detachment position by weight of the slider.

2. The liquid discharge apparatus according to claim 1, further comprising:
a rotating body configured to convey a sheet,
wherein the rotating body includes side plates on opposing sides in the axial direction configured to support the discharge receptacle, and
one of the side plates rotatably supports one end of the support case.

3. The liquid discharge apparatus according to claim 2, wherein the discharge receptacle includes a plurality of discharge receptacles, and
the plurality of discharge receptacles is disposed inside the rotating body around a circumference of the rotating body.

4. The liquid discharge apparatus according to claim 2, wherein another of the side plates detachably engages with another end of the support case at the installation position.

5. The liquid discharge apparatus according to claim 4, wherein the rotating body includes a latching pin on the other of the side plates engageable with a latching hook on the other end of the support case at the installation position.

6. The liquid discharge apparatus according to claim 5, wherein the latching hook is on a handle that is rotatably held by the slider.

7. The liquid discharge apparatus according to claim 2, wherein the rotating body includes a holder on the one of the side plates, and
the holder includes a support shaft to support the one end of the support case.

8. The liquid discharge apparatus according to claim 1, wherein the discharge receptacle further includes:
a resistance configured to apply resistance to a movement of the slider outside the support case.

9. The liquid discharge apparatus according to claim 1, further comprising:
a spring configured to apply a force to the support in a direction opposite to a displacement direction of the support of the discharge receptacle displaced to the detachment position.

10. A liquid discharge apparatus comprising:
a drum configured to convey a sheet;
a head configured to discharge a liquid; and
a discharge receptacle disposed inside the drum and configured to receive the liquid discharged from the head at an installation position,
wherein the discharge receptacle includes:
a liquid holder configured to receive the liquid discharged from the head; and
a support comprising a support case attached to the drum, and a slider slidably movable with respect to the support case and configured to detachably support the liquid holder,
the support case is rotatably attached to drum to rotate in a radial direction of the drum between the installation position and a detachment position where the support case is tilted obliquely downward.

11. The liquid discharge apparatus according to claim 10, wherein the drum includes side plates on opposing sides in an axial direction configured to support the discharge receptacle, and
a first one of the side plates rotatably supports one end of the support case.

12. The liquid discharge apparatus according to claim 11, wherein the drum includes a holder on the first one of the side plates, and
the holder includes a support shaft to support the one end of the support case.

13. The liquid discharge apparatus according to claim 11, wherein a second one of the side plates detachably engages with another end of the support case at the installation position.

14. The liquid discharge apparatus according to claim 13, wherein the drum includes a latching pin on the second one of the side plates engageable with a latching hook on the other end of the support case at the installation position.

15. The liquid discharge apparatus according to claim 14, wherein the latching hook is on a handle that is rotatably held by the slider.

16. The liquid discharge apparatus according to claim 13, wherein the other end of the support case is detached from the second one of the side plates at the detachment position, and the support case is tilted obliquely downward such that the other end of the support case is lower than the one end of the support case that is rotatably supported by the first one of the side plates.

17. The liquid discharge apparatus according to claim 10, wherein the discharge receptacle further includes:

a resistance configured to apply resistance to a movement of the slider outside the support case.

18. The liquid discharge apparatus according to claim 10, further comprising:

a spring configured to apply a force to the support in a direction opposite to a displacement direction of the support of the discharge receptacle displaced to the detachment position.

* * * * *